US005958115A

United States Patent [19]

Böttcher et al.

[11] Patent Number: 5,958,115

[45] Date of Patent: Sep. 28, 1999

[54] CORROSION-INHIBITING COMPOSITE MATERIAL

[75] Inventors: Horst Böttcher, Dresden; Karl-Heinz Kallies, Sebnitz; Georg Reinhard, Dresden; Gerhard Hahn, Münden, all of Germany

[73] Assignees: EXCOR Korrosionsschutz-Technolgien und—Produkte GmbH, Münden; Feinchemie GmbH Sebnitz, Sebnitz, both of Germany

[21] Appl. No.: 09/028,699

[22] Filed: Feb. 24, 1998

[30] Foreign Application Priority Data

Feb. 28, 1997 [DE] Germany ..... 197 08 285

[51] Int. Cl.[6] ..... C09K 3/00; C23F 11/00

[52] U.S. Cl. ..... 106/14.05; 106/14.41; 239/60; 252/389.3; 252/389.31; 252/390; 422/9; 427/397.7; 501/12; 516/111

[58] Field of Search ..... 252/389.3, 389.31, 252/390; 422/9; 239/60; 516/111; 427/397.7; 501/12; 106/14.05, 14.41

[56] References Cited

U.S. PATENT DOCUMENTS

| | | | |
|---|---|---|---|
| 3,836,077 | 9/1974 | Skildum | 239/60 |
| 3,887,481 | 6/1975 | Korpics | 252/390 X |
| 3,891,470 | 6/1975 | Kotone et al. | 252/390 X |
| 3,967,926 | 7/1976 | Rozenfeld et al. | 239/54 X |
| 4,124,549 | 11/1978 | Hashiudo et al. | 252/390 X |
| 4,275,835 | 6/1981 | Miksic et al. | 252/390 X |
| 4,290,912 | 9/1981 | Boerwinkle et al. | 422/8 X |
| 4,671,933 | 6/1987 | Lengnick et al. | 252/389.32 X |
| 4,788,164 | 11/1988 | Che et al. | 501/12 X |
| 5,028,489 | 7/1991 | Kissel | 106/14.05 X |
| 5,139,700 | 8/1992 | Miksic et al. | 252/389.54 |
| 5,209,869 | 5/1993 | Miksic et al. | 252/389.54 |
| 5,268,199 | 12/1993 | Brown, Jr. et al. | 106/14.44 X |
| 5,270,027 | 12/1993 | Balducci et al. | 516/111 X |
| 5,332,525 | 7/1994 | Miksic et al. | 252/389.54 |
| 5,393,457 | 2/1995 | Miksic et al. | 252/194 |
| 5,397,390 | 3/1995 | Gorecki | 106/14.44 X |

FOREIGN PATENT DOCUMENTS

| | | |
|---|---|---|
| 0 639 657 A1 | 2/1995 | European Pat. Off. . |
| 0 662 527 A1 | 7/1995 | European Pat. Off. . |
| 1 521 900 | 5/1969 | Germany . |
| 23 56 888 | 5/1975 | Germany . |
| 35 18 625 A1 | 11/1986 | Germany . |
| 35 45 473 A1 | 7/1987 | Germany . |
| 295 668 A5 | 11/1991 | Germany . |
| 40 40 586 A1 | 6/1992 | Germany . |
| 92 10 805 | 2/1994 | Germany . |
| 58-193377 | 11/1983 | Japan . |
| 61-227 188 | 10/1986 | Japan . |
| 62-063 686 | 3/1987 | Japan . |
| 63-028 888 | 2/1988 | Japan . |
| 63-183 182 | 7/1988 | Japan . |
| 4- 83 734 | 3/1992 | Japan . |
| 58-63732 | 4/1993 | Japan . |
| 63-210 285 | 8/1998 | Japan . |
| 600328 | 4/1948 | United Kingdom . |
| 893397 | 4/1962 | United Kingdom ..... 252/389.31 |
| 919778 | 2/1963 | United Kingdom . |

OTHER PUBLICATIONS

H.H. Uhlig, "Corrosion and Corrosion Protection", Akademie–Verlag Berline, 1970, p. 247 et seq.

I.L Rosefeld, "Corrosion Inhibitors", Izt–vo Chimija Moskva 1977, p. 316 et. seq.

Patent Abstracts of Japan, vol. 015, No. 248 (1991).

*Primary Examiner*—Richard D. Lovering

*Attorney, Agent, or Firm*—Frishauf, Holtz, Goodman, Langer & Chick, P.C.

[57] ABSTRACT

The invention relates to a corrosion-inhibiting material comprising a composite containing a metal oxide gel, where necessary modified by an organic polymer, and one or more corrosion inhibitors, and to a method for the production thereof. The corrosion-inhibiting composite material is used for producing corrosion-protective packaging material, for coating metallic and metallized articles as well as for corrosion protection in confined environments.

17 Claims, No Drawings

CORROSION-INHIBITING COMPOSITE MATERIAL

BACKGROUND OF THE INVENTION

1. Field of the Invention

The invention relates to a corrosion-inhibiting material comprising one or more volatile corrosion inhibitors evenly distributed in a metal oxide gel matrix. The metal oxide gel controls the release of volatilized inhibitor.

2. Background

It is known that corrosion inhibitors having a tendency to sublimate under normal conditions in the powder form and being able to gain access to the metal surfaces to be protected via the gas phase may be put to use for temporary corrosion protection of metal articles within confined environments, e.g. in packages or show cases. These so-called vapor phase corrosion inhibitors (VPI) or volatile corrosion inhibitors (VCI) are typically employed as a volatile powder, packaged in bags of a vapor phase-permeable material.

The present invention can use as a VCI, any known volatile corrosion inhibitor or inhibitors. These are exemplified in the discussion of the prior art presented below, the disclosures of various VCI being incorporated herein by reference.

Variants of volatile corrosion inhibitors (VCI) are known e.g. from H. H. Uhlig "Corrosion and Corrosion Protection" (German), Akademie-Verlag Berlin, 1970, page 247 et.seq. or from I. L. Rozenfeld "Corrosion Inhibitors" (Russian), Izt-vo Chimija Moskva 1977, page 316 et. seq. Their drawback is that VPI release occurs in an undefined manner and no homogenous distribution throughout the gas environment can be assured. Further disadvantages include the risk of the bag containing the VCI being mechanically ruptured, resulting in undesirable contamination of the packaged articles as well as in problems resulting from the irregular distribution of the bags in large-area storage rooms and large containers.

Attempts to obviate these disadvantages by many ways and means, have been described. U.S. Pat. No. 3,836,077 proposes employing a VCI mixture in the form of compressed pellets and either to avoid completely a gas-permeable container material or to make use of the pellets embedded in foamed materials provided with suitable cavities. By contrast, U.S. Pat. Nos. 3,967,926; 5,332,525 and 5,393,457 propose mixing the VCI's with a chemically inert powder or a drying agent such as silica gel or zeolite. This allows use of tougher, air-permeable plastic films or capsules to replace bags made of natural products (cotton, linen, etc) which were used earlier with the intention that the inert substrate material contributes, by its porous structure, to continual sublimation of the VCI components distributed therebetween. The drying agent was used to counteract an agglomeration of the finely dispersed VCI components into larger mixed particles (e.g. clumping with a crusted surface due to water being absorbed). However, in practice, the use of drying agents normally results in the opposite of the desired effect and leads to clumping following water absorption. In addition, the mechanically more stable container materials have a lesser permeability to the VCI vapor than the natural products so that their emission rate is reduced, this being the reason why a larger number of VCI reservoirs are needed than when using containers of natural products for controlling the level of VCI vapor concentration necessary for corrosion protection. This drawback further complicates and makes temporary corrosion protection, especially in spacious interiors, even more expensive.

For eliminating the complicated step of assuring homogenous distribution of VCI reservoirs in the interiors of packages commensurate with automated packaging systems, attempts have been made to suitably fix the VCI to the packaging material, these attempts initially being dominated naturally by paperboards and packing papers. To ensure directed emission of the released vapors of the applied VCI into the interiors the VCI components are usually applied to only one side of the packaging materials while the other side later arranged as the outer front side, receives a protective lacquer coating which is inherently water-repellant and may also act as a vapor barrier for the VCI existing on the reverse side (cf. e.g. H. H. Uhlig, loc cit). The problem still existing today is fixing the VCI to the surface of paperboard or packing paper to be stable in dimension and quantity. If the VCI is applied within an organic coating material, many substances effective as VCI cannot be put to use since they enter into a chemical reaction with the binding agent of the coating material, becoming trapped in the resulting polymer matrix and are no longer capable of sublimation. This drawback is evident in the case of e.g. VCI's embedded in acrylate, alkyd, epoxide or phenolic resin-based polymer binding agents.

As an alternative the VCI is dissolved in an organic solvent with which the packaging material is soaked. Methods of this kind involving various active substances and solvents are described e.g. in JP 61-227188, JP 62-063686, JP 63-02888, JP 63-183182, JP 63-210285 and U.S. Pat. No. 3,887,481. However, these all have the disadvantage that after evaporation of the solvent the VCI is present within the pores of the corresponding substrate in the form of fine crystals which adhere to the packaging material only slightly. There is therefore the risk of these active substances becoming dissociated from the packaging material and thus there is no assurance that the paperboards and papers pretreated therewith exhibit the necessary specific surface concentration of VCI at the time of their use for corrosion protection.

To confine this drawback at least in its extent it is proposed in DE 9210805 to prepare only one ply of the corrugated paperboard as the substrate and depot for the sublimable corrosion inhibitors and to cover this ply on both sides by at least one further porous ply so that the VCI deposit is located in the interior of the paperboard. Since this hampers VCI emission into the interior of the package it is proposed in JP 4 083 943 to use instead of corrugated paperboard or paper an expanded polyurethane having a substantially higher porosity and is thus able to absorb much larger quantities of VCI. However, the disadvantage here is that after evaporation of the solvent the VCI is present in the pores of the foamed material as crystals with less tack so that the VCI may easily bleed uncontrolled should the packaging material be ruptured.

JP 58-063732 and U.S. Pat. No. 4,275,835 thus specify methods in which the VCI is a component of the foamed polymer, this making it necessary that the crystalline VCI is dispersed in one of the starting components. Despite highly complicated and energetic methods this is possible to only a limited extent since VCI usually belong to other classes of substances, as a result of which the stability is low. These methods are further aggravated as modern VCI's themselves comprise several substances having differing chemical properties and thus, as far as these can be dispersed at all together with the components for expanded materials, such dispersions usually have a very broad grain size spectrum, low stability and are problematic in processing.

DD 295 668 specifies a method of producing polyurethane systems containing VCI in which the VCI are first dissolved in a multifunctional alcohol having the mol mass 500 to 1000 g/mol and are subsequently introduced into the polyol before the polyurethane is generated by the addition of polyisocyanate, a catalyst, stabilizer and an expanding agent. This method is, however, restricted only to VCI which are soluble in alcohols having the necessary concentration for the corrosion protection while not being detrimental to the expansion process as a constituent of the polyol component. This method is thus not suitable to satisfy the complex requirements made nowadays on temporary corrosion protection of ferrous and non-ferrous metals as well as on multi-metal combinations, since it excludes practically all inorganic active substances from the application.

To avoid these drawbacks and to provide VCI-vapor emitting packaging material suitable for application in modern packaging, storage and transport systems it is proposed in U.S. Pat. No. 4,124,549; U.S. Pat. No. 4,290,912; U.S. Pat. No. 5,209,869; EP 0 639 657 and DE-OS 3 545 473 to introduce the VCI during extrusion of films of polyolefines so that a physically stable polymer packaging material results from which the VCI are emitted. EP 0 662 527, DE-OS 4 040 586, DE OS 3 518 625 and U.S. Pat. No. 5,139,700 propose as a further sophistication employing such a polyethylene or polypropylene-based film containing VCI only in conjunction with laminated multi-ply materials, whereby one ply oriented outwards consists of an Al foil or a film of polymer densely cross-linked functioning as a vapor barrier as regards the active substances emitted from the ply containing the VCI and prompting directed transport of VCI into the interior of the packaging material. Producing polymer films containing an inhibitor by extruding a blend containing substances tending to sublimate is naturally thwart with difficulties: (a) the high volatility of VCI at temperatures at which the extrusion process is undertaken results in significant losses of these substances as well as to expansion of the film, impairing their closed configuration and thus to an uncontrolled reduction in their strength and protective properties, (b) there is a possibility of thermal decomposition of the corrosion inhibitors and undesirable thermochemical reactions with the polymer matrix. The serious disadvantage resulting therefrom is that it is hardly possible in this way to produce a packaging material having reproducible, uniform surface properties.

The object of the invention is to provide an improved material for fixing vapor phase or volatile corrosion inhibitors mechanically and chemically stable to solid surfaces and a corrosion-protective packaging material. The fixing material is intended to permit universal and technically simple application, more particularly independently of the physical and chemical properties of the active substances and the nature of the substrate surface while obviating the drawbacks of the methods as described above. It is furthermore an object of the invention to define a method for producing such a material.

BRIEF DESCRIPTION

Briefly, these objects are achieved by a corrosion-inhibiting composite material of a volatile corrosion inhibitor and a metal oxide sol which can be coated on or impregnated into a substrate, a packaging material having been impregnated with or coated with the composite and a method of producing the packaging material by coating or impregnating a packaging substrate with the composite.

Surprisingly these objects were able to be achieved in accordance with the invention by embedding known volatile corrosion inhibitors in diffusion-inhibiting metal oxide gels (preferably as coatings), the inorganic matrix being modified by organic polymers such that synergetic effects result as regards immobilization and coating quality. By selecting the composition of the metal oxide gel and the production technology the porosity of the composite formed can be varied so that a stable release of the volatile corrosion inhibitor into the gas phase occurs over an extended period of time.

The corrosion-inhibiting composite material is used to produce corrosion-protective packaging materials, to coat metallic and metallized articles as well as for corrosion protection in confined environments.

The subject matter of the invention is also a corrosion-inhibiting material comprising a composite of a metal oxide gel, modified, where necessary, by an organic polymer and one or more corrosion inhibitors, a method for the production thereof or the use of a corrosion-inhibiting composite material for the production of corrosion-protective packaging materials, for coating metallic and metallized articles as well as for corrosion protection in confined environments.

THE INVENTION

The corrosion-inhibiting composite material of the present invention is a composite of a metal oxide gel and one or more volatile corrosion inhibitors which are homogeneously distributed within the metal oxide gel. Preferably the volatile corrosion inhibitors are present in an amount of about 1% to about 15%, more preferably 1–5% by weight, based on the weight of metal oxide in the gel and are evenly distributed in the gel. The composite, made by the preferred method described below, is in the form of a solid solution wherein the corrosion inhibitor or inhibitors are distributed on a molecular basis. This provides a substantially homogenous distribution of VCI within the metal oxide gel matrix. The release of VCI vapor is therefore controlled by the metal oxide gel matrix in which it is distributed.

Metal oxide gels such as $SiO_2$, $Al_2O_3$, $TiO_2$, $ZrO_2$ or ZnO or mixtures thereof may be used as the matrix component, obtained by a sol gel process, e.g. by hydrolysis of the corresponding metal alkoxides into the corresponding metal oxide sols and subsequent gel formation by neutralization, heating or upwards concentrating, cf. J. C. Brinker, G. W. Scherer, "Sol-Gel Science", Academic Press, London 1990. Forming the metal oxide sols is done by acidic or basic catalyzed hydrolysis of the corresponding metal alkoxides in water or any organic solvent miscible in water (e.g. ethanol):

$$Me(OR)_n + n/2\ H_2O \longrightarrow (MeO_m)_{sol} + n\ ROH \quad (1)$$

(Me = metal e.g. Si, Al, Ti, Zr, Zn, R = organic residue, e.g. alkyl, acyl; n takes a value dependent on the valence of the metal).

The metal oxide sols represent water-clear, stable solutions having a metal oxide content of about 3 to 20% by weight. The metal oxide particles are present in nanocrystalline spherical form (diameter about 2 to 5 nm). The solvent can be selected optionally. The metal oxide sols feature, among other things, the following special features:

(1) On a change in pH or increase in temperature the sols gel into water-clear gels which when dried furnish porous powders $$(MeO_m)_{sol} \longrightarrow (MeO_m)_{gel} \quad (2)$$

(m takes a valence dependent on the valence of the metal)

(2) The sols gel in coating optional films or shaped bodies and form transparent films.

(3) In the sols, various active substances can be dissolved and after gelling can be effectively and homogeneously embedded in the metal oxide structure, resulting in metal oxide composites (as a powder or film). The active substances are distributed in the composite in a molecular-dispersed manner.

For modifying the coating properties the above hydrolysis process (1) of the metal alkoxides can be carried out in the presence of admixed alkyl-trialkoxysilane $R\text{-}Si(OR')_3$ forming modified metal oxide gels which relative to 1 part by weight metal oxide gel contain up to 1 part by weight $R\text{-}SiO_n$, where R is an organic alkyl radical which may contain amino, hydroxy or alkoxy groups, R' is an alkyl residue, preferably having 1 to 4 atoms of carbon and n is <2. By this form of modification the mechanical properties of the coating can be improved and its porosity varied.

A further possibility of modifying the metal oxide gel for improving the coating quality consists of modifying 1 part by weight metal oxide gel with up to 1 part by weight of a dissolved or dispersed organic polymer such as cellulose derivatives, starch derivatives, polyalkylene glycols or derivatives thereof, acrylate and methacrylate-based homo- or copolymerisates, polystyrene sulfonate or natural resins, or blends of the cited polymers. Examples of preferred polymers as a composition component are polystyrene sulfonic acid, hydroxypropyl-, methyl- and carboxymethylcellulose or colophonium. The polymer addition has two functions: (a) by changing the composite structure, where necessary still supported by ionic groups as in the case of polystyrene sulfonate, the release of the corrosion-inhibitor can be delayed, (b) by the polymer addition, more particularly soluble cellulose derivatives, the viscosity of the sols and thus under constant coating conditions the thickness of the coating can be greatly increased, thus making it possible to control the absolute quantity of released corrosion inhibitor within broad limits.

All substances, the presence of which inhibits corrosion, for example, substituted phenols, hydroquinone and quinone derivatives, nitrates, organic acids, salts of organic acids, aliphatic or aromatic amines, amides, thiazoles, triazoles, imidazoles or mixtures thereof can be put to use as the corrosion-inhibiting substances. Depending on solubility, volatility and molecular weight their percentage in the composite may be 1 to 50% by weight.

The steps involved in the method of producing a corrosion-inhibiting composite material are as follows:

(a) Producing a metal oxide sol containing $SiO_2$, $Al_2O_3$, $TiO_2$, $ZrO_2$ or ZnO or mixtures of the metal oxides or which may be modified by $R\text{-}SiO_n$, by hydrolysis of the corresponding metal alkoxides in an aqueous, organic or mixed solvent, where necessary with the addition of diluted mineral acid, aqueous alkali, fluoride or tertiary amines as hydrolysis catalysts; preferably ethanol, acetone or dioxane being used as the organic solvent.

(b) optionally adding dissolved or dispersed polymers for modifying the coating properties, the component being selected relative to the metal oxide sol so that the resulting modified metal oxide sol has a viscosity of at least 5 mPa/20° C.; the polymer percentage being typically in a range of 0.1 to 20% by weight relative to the metal oxide.

(c) Dissolving the corrosion inhibitor in the (where necessary, polymer-modified) metal oxide sol. The inhibitor may also be admixed prior to or during the hydrolytic formation of the metal oxide sols (1) if it is stable relative to the hydrolysis conditions (pH and solvent milieu). For application of inorganic inhibitors such as sodium nitrite it is recommendable in view of the restricted solubility in organic solvents to maintain the percentage of organic solvent in the metal oxide sol low to avoid flocculation. This can easily be done by e.g. distillative removal of the organic solvent with simultaneous addition of water in a quantity equivalent to the volume. In this way sufficiently stable, purely water-modified metal oxide sols are attained, resulting in homogenous mixtures with the water-soluble inorganic corrosion inhibitors.

(d) Gelling the metal oxide sol containing the inhibitor by heating or neutralizing to produce bulk products, e.g. for producing a powdered corrosion-inhibiting composite material, or by coating the metal oxide sol containing the active substance on a substrate such as paper, carton, polymer films or expanded materials, textile fabric or on metallic or metallized articles to be protected directly.

(e) Coating may be done by usual coating techniques such dip, spray or spin coating, by brush or pour application. For coating foamed materials it is advantageous to pass the penetrated foamed material through a pair of rollers prior to drying, the nip of the rollers making it convenient to regulate the desired impregnation with the corrosion-inhibiting composite material.

(f) Removing the solvent can be done by usual drying methods such as air, vacuum or freeze drying. The dry coating thicknesses obtained are typically in the range 0.08 to 2 $\mu$m.

The corrosion-inhibiting composite materials thus obtained excel by being simple to produce, feature long-term stability due to the known chemical inertness of matrix components (pure silicon dioxide in the simplest case), excellent coating properties and an effective immobilization for a high corrosion-inhibiting effect. Further advantages are their suitability for practically all inorganic and organic classes of substances, good bonding to a wide variety of packaging materials and metallic articles as well as the possibility of being able to control the porosity of the composite material within broad limits by the formulation and production technology.

The material in accordance with the invention is thus particularly suitable for producing corrosion-protective packaging materials for coating metallic or metallized articles to be protected directly as well as for corrosion protection of confined environments by means of powdered corrosion-inhibiting composite materials.

EXAMPLES

1. Metal Oxide Sol Production (a) Aqueous alcoholic acidic $SiO_2$—sol A 50 ml tetraethoxysilane, 200 ml ethanol and 100 ml 0.01N hydrochloric acid are mixed for 20 hours at room temperature to obtain a stable $SiO_2$ sol (4.2% solids content in 70% ethanol, pH approximately 4).

(b) Aqueous acidic $SiO_2$—sol B 200 ml sol A are mixed with 140 ml water. The mixture is heated in a distillation vessel over a boiling water bath and 140 ml ethanol distilled off to obtain, after cooling, a clear $SiO_2$ sol with 4.2% solids content in water (pH approximately 4).

(c) Aqueous acidic $SiO_2$ containing dioxane—sol C 50 ml tetraethoxysilane, 200 ml dioxane and 100 ml 0.01N hydrochloric acid are mixed for 20 hours at room temperature to obtain a stable $SiO_2$ sol (4.2% solids content in 70% dioxane, pH approximately 4).

Aqueous alcoholic alkaline $SiO_2$—sol D 50 ml tetraethoxysilane, 200 ml ethanol and 0.25% ammoniac solution are mixed for 20 hours at room temperature to obtain a stable $SiO_2$ sol (4.2% solids content in 70% ethanol, pH approximately 9).

Aqueous alcoholic acidic sol E of $SiO_2/CH_3SiO_{1.5}$ 35 ml tetraethoxysilane, 15 ml trimethoxymethylsilane are mixed in 200 ml ethanol and 100 ml 0.01N hydrochloric acid for 20 hours at room temperature to obtain a stable, modified $SiO_2$ sol (4.2% solids content in 70% ethanol, pH approximately 4).

Alcoholic sol F from $SiO_2$—$TiO_2$ 1 g 1.1.1-tris-(hydroxymethyl)propane in 10 ml ethanol, 10 ml tetraethoxysilane and 3 ml 3-glycidyloxypropyltrimethoxysilane are mixed with 2.2 g titanium tetraisopropylate in 30 ml abs. etanol. At room temperature, 3 ml 0.01N hydrochloric acid in 10 ethanol are with slow drop-by-drop addition (approximately 12% solids content in pure ethanol, pH approximately 4).

(g) Alcoholic polymer-modified sol G $SiO_2$—$TiO_2$ 100 ml sol F (viscosity 4.5 mPa, 20° C.) are mixed with 0.2 g Klucel H/Aqualon GmbH (hydroxypropylcellulose) for 20 hours and filtered through a fritted glass material. The resulting sol G has a viscosity of 48 mPa, 20° C. Dip-coating a steel plate results with a typical drag rate of 30 cm/min with sol F a dry coating thickness of 0.63 $\mu$m, with sol G 2.8 $\mu$m.

(h) Aqueous alcoholic sol H of $SiO_2$—ZnO 80 ml sol F are mixed with 20 ml 10% aqueous zinc acetate solution for 10 hours to obtain a stable, colorless sol (approximately 11.5% solids content).

2. Producing the Corrosion-Inhibiting Composite Materials

The sols listed in Table 1 are mixed with the dissolved corrosion inhibitors and therewith (a) various substrates are coated or (b) the mixture caused to gel by neutralization in 2% ammoniac solution and heating to 60° C. To remove the organic solvent the solid gel is initially dried in air and subsequently dried in a vacuum desiccator to remove the remaining moisture.

TABLE 1

Producing corrosion-inhibiting composite materials

| No. | Sol (100 ml) | Inhibitor | Coating |
|---|---|---|---|
| 1 | A | 20 ml dicyclohexylammonium nitrite (5% in 90% EtOH) | dip, paper |
| 2 | D | 20 ml dicyclohexylammonium nitrite (5% in 90% EtOH) | dip, paper |
| 3 | B | 50 ml $NaNO_2$ + subst phenol[1)] (2% in 60% EtOH) | dip, paper |
| 4 | H | 20 ml hydroquinone + subst. phenol[2)] (2% in EtOH) | dip, paper |
| 5 | H | 20 ml hydroquinone + subst. phenol[2)] (2% in EtOH) | dip, steel |
| 6 | C | 20 ml hydroquinone + subst. phenol[2)] (2% in EtOH) | expanded PUR dip roll |
| 7 | F | 50 ml 8-oxyquinoline + subst. phenol[1)] (2% in EtOH) | brush, paper |
| 8 | E | 50 ml 8-oxyquinoline + subst. phenol[1)] (2% in EtOH) | brush, paper |

TABLE 1-continued

Producing corrosion-inhibiting composite materials

| No. | Sol (100 ml) | Inhibitor | Coating |
|---|---|---|---|
| 9 | E | 50 ml 8-oxyquinoline + subst. phenol[1)] (2% in EtOH) | gel, dry mortared to powder |
| 10 | G | 50 ml ascorbic acid + benzoquinone (2% in EtOH) | brush, paper |

[1)]2.6 Di-tert. butyl-4-methylphenol
[2)]2.6 Di-octadecyl-4-methylphenol

3. Comparative Test Results of Corrosion-Inhibiting Composite Materials

Sample No. 1 (cf. Table 1)

The VCI-containing paper produced in accordance with the invention was tested in comparison with commercially-available corrosion-protective paper (R1) serving as a reference system according to the method as usual in actual practice for "Testing the corrosion-protective effect of VCI packaging materials" (cf. German "Verpackungs-Rundschau" 5/1988, page 37 et.seq.). Chemical analysis revealed that R1 contained the active substances dicyclohexylamine, Na nitrite, Na salt of caprylic acid, urea and benzotriazole, the first two-mentioned substances were present roughly in the same percentage as the dicyclohexylammonium nitrite in paper No. 1. The test articles used were of non-alloyed mass steel St-38 u2. These were pretreated in accordance with the specification and placed by themselves or together with the VCI packaging material to be tested in tightly sealed containers in which conditions were set resulting in water condensation on the surface of the test objects. The ground surface area of the test objects was inspected visually for the existance of signs of corrosion regularly in accordance with the specification.

The blind specimens employed without application of VCI showed first signs of corrosion in the edge zone already after 26 hours immersion; the test objects exposed together with the R1 paper showed rust spots distributed relatively uniformly over the surface after approximately 11 days. The paper No. 1 produced in accordance with the invention ensured its full corrosion protection effect even after 21 days of exposure in accordance with the specification, this being seen from the satisfactory appearance of the corresponding test objects.

Sample No. 2 (cf. Table 1)

The corrosion protection properties of the VCI-containing paper produced in accordance with the invention was tested the same as expanded PUR coated in accordance with the invention (POLYFORM ET PF 193, Polyform Kunststofftechnik GmbH Rinteln) by segments being cut out thereof and placed together with sheets of Al 99 or galvanized steel (Zn coating 8 $\mu$m) in closed glass containers above a saturated solution of disodium hydrogen phosphate. The latter adjusts to a rel. humidity (RH)=95% in the confined gas environment at 25° C. In this arrangement the segments of the VCI packaging material exhibited the same geometric surface as the test sheets used and were arranged spaced away from each other by approximately 2 cm. The test sheets were coated with 0.01 M common salt solution directly prior to being exposed in the test chamber. As a reference to packaging material in accordance with the invention commercially-available VCI paper (R2) containing the active substances di- and triethanol amine, the Na salts of caprylic and benzoic acid as well as benzotriazol was tested in the same way for this purpose.

While the Al sheets employed as blind specimens showed first evidence of white spot deposits already after approximately 40 hours the system (R2) ensured its protective function for approximately 9 days. The tests with the paper and expanded PUR packaging material treated with VCI in accordance with the invention were discontinued after 32 days with the test sheets having a totally satisfactory appearance.

First white deposits in the edge zones were already evident after approximately 30 hours on the galvanized sheets used as the blind specimens. Using (R2) delayed this effect to approximately 12 days. The tests with packaging material treated with VCI in accordance with the invention were discontinued after approximately 40 days since no changes whatsoever were found.

Sample No. 3 (cf. Table 1)

Sheets having the dimensions (76×152×5) mm of cast iron GGl 25, evident contaminations of which were removed by rubbing with emery cloth grain size 280, were deposited in a humid confined environment with (RH)=93% and 40° C. without and with simultaneous placement of a dish containing powder emitting VCI vapor. In addition to the composite No. 3 in accordance with the invention a commercially-available granulate (R3) was tested which according to a chemical analysis contained the active substances dicyclohexyl ammonium molybdate, sodium nitrite and benzotriazole.

The VCI-containing solids were put to use finely distributed in an expansive dish with 1 g/100 cubic meter humidity volume. In the pure humid air first signs of rust patches were already observable on the cast iron sheets after approximately 7 hours. In the chamber accommodating the commercially-available VCI granulate the corrosion protection was maintained approximately 62 hours. The specimens which were exposed to the humid atmosphere together with the VCI vapor-emitting powder in accordance with the invention still showed no evidence of rusting even on discontinuation of the tests after 20 days. Responsible for this in accordance with the invention is both the novel combination of corrosion inhibitors employed and the constitution of the VCI-containing composite ensuring continual emission in the gas phase.

Sample No. 4 (cf. Table 1)

The paper produced by the method No. 4 in accordance with the invention was tested as regards its suitability for maintaining the gloss of sheets of anodized aluminum. Gloss assessment was done according to the GLOSScomp/OPTRONIK Berlin measurement system which obtains from the corresponding reflection curve of the substrate the measurement parameters maximum value P/dB (peak height), maximum rise A/(dB(deg), half-value width HW/deg of the reflection curve and computes therefrom the visual gloss Gt in %.

A loss in gloss due to initial signs of corrosion is represented by low values of P, A and Gt as well as an increase in HW.

Sheets of aluminum having the starting data P=46.2 dB, A=14.9 dB/deg, HW=7.6 and Gt=77.7% were exposed unpackaged or wrapped in a layer of VCI vapor-emitting paper to an alternating condensate atmosphere in accordance Genua standard with DIN 50017. Serving as the reference system was a commercially-available VCI paper containing according to the chemical analysis the active substances monoethanolamine, benzoic acid, Na-benzoate, urea and glycerine (R4).

After a 3 day exposure the Al sheets employed as blind specimens exhibited a Gt of only 28.9% whereas the sheets packaged in (R4) still had a gloss of Gt=74.5% and the sheets packaged with the paper produced in accordance with the invention exhibited Gt=77.0%. After 16 days exposure this value had not changed within the scope of accuracy afforded by the measurement while Gt=33% was all that was measured on the specimens packaged in (R4). This documents the superiority of paper No. 4 treated in accordance with the invention for the purposes of corrosion protection.

Sample No. 5 (cf. Table 1)

Sheets of anodized Al coated in accordance with the invention were characterized as regards their gloss, again using the GLOSScomp measurement system as cited in example No. 4.

As compared to uncoated Al sheets the visual gloss prior to commencement of testing averaged Gt=82%, it being even approximately 5% higher. The dry coating thicknesses of approximately 20 μm produced as the reference system (R5) with a commercially-available alkyd resin varnish in spin coating exhibited, as compared to the latter, values of only Gt=68% in the starting condition. The coated and uncoated sheets were exposed to cyclic changes in humidity in the climatic cabinet in accordance with IEC 68-2-30, a 24 hour cycle comprising the following phases: 6 hour 25° C and (RH)=98%, 3 hour heating-up phase from 25 to 55° C at (RH)=95%, 9 hour 55° C at (RH) 93% and 6 hour cooling phase from 55 to 25° C. at (RH)=98%. After each cycle the surface condition of the specimen sheets was visually assessed.

The non-treated sheets of aluminum exhibited stains already after 4 cycles which resulting in Gt values of around 36% greatly differing locally. A reduction in the Gt values was observed on (R5) sheets after 8 cycles, initially caused by bloating of the organic coating associated with water absorption. The Gt values of the Al sheets coated in accordance with the invention showed no change even after 30 cycles within the scope of accuracy afforded by the measurement.

Sample No. 6 (cf. Table 1)

Polished sheets of Cu and brass Ms63 were sandwiched between sheets of expanded PUR coated in accordance with the invention and the same in size and welded in films of pure polythene (100 μm). The specimens packed in this way were exposed to the humid climate test in accordance with IEC 68-2-30 as described relevant to No. 5. Along with this, specimens of the cited materials were deposited in the climatic cabinet without any VCI vapor-emitting expedient or in common with a commercially-available film material as reference system (R6). According to its chemical analysis (R6) contained the active substances ammonium molybdate, triethanolamine and benzotriazole.

The blind specimens showed evidence of slight dark staining to their surface after 7 cycles. Similar staining occurred on the Cu after 12 cycles and on the brass after 16 cycles in the case of the specimens packaged in (R6). There was no absolutely no change in appearance of the sheets deposited with the VCI vapor-emitting packaging material in accordance with the invention on discontinuation of testing after 31 cycles.

Sample No. 7 (cf. Table 1)

The corrosion protection function of the VCI paper No. 7 produced in accordance with the invention was tested in the same way as for No. 1. The result was an equivalent inhibitor effect. This would appear to be particularly remarkable. While the VCI put to use in the case of No. 1 is dicyclohexyl ammonium nitrite as known and used already since many years, which was fixed in the way described only as a stable functioning reservoir, use of 8-oxychinoline as the VCI has first become possible by fixing to the surfaces of solids in accordance with the invention. This example documents that in addition to active substances as already known, substances which hitherto were not applicable by existing methods of processing can now be introduced as new VCI by production of corrosion-inhibiting composite materials in accordance with the invention. This has also been successfully tested by a series of other active substances not mentioned here by way of example.

Sample No. 8 (cf. Table 1)

Laminar copper provided on the outside with a thin coating of nickel non-electrically (chemically) needs to remain bondable even after lengthy storage in dry air at room temperature in meeting the requirements of the semiconductor industry; this generally not being the case due to aging of the primary oxide film existing on the nickel surface in conjunction with vestiges of the chemical nickel coating still present thereon. Using the reference system (R1) cited under No. 1 failed to inhibit this aging process. The chemically nickel coated laminar structure could no longer be bonded after being stored in this VCI paper on an average after 5 days. When, by contrast, the laminar structure was directly transferred on completion of nickel coating into an desiccators the base of which was filled with powder No. 8 as produced in accordance with the invention, aging of the Ni primary oxide film was inhibited and the laminar structure could be bonded even after 24 days storage.

It will be appreciated that the instant specification is set forth by way of illustration and not limitation and that various modifications and changes may be made without departing from the spirit and scope of the present invention.

What is claimed is:

1. A corrosion-inhibiting composite material comprising a composite of a metal oxide gel and one or more volatile corrosion inhibitors which are homogeneously distributed in a molecular-dispersed manner within the metal oxide gel.

2. The composite material as set forth in claim 1 wherein the metal oxide gel contains $SiO_2$, $Al_2O_3$, $TiO_2$, $ZrO_2$ or ZnO or mixtures thereof.

3. The composite material as set forth in claim 1, wherein one part by weight $SiO_2$ is co-condensed with x part by weight ($0<x<1$) R-$SiO_n$ as the metal oxide gel, where R is an organic alkyl radical optionally containing amino, hydroxy or alkoxy groups, and $n<2$.

4. The composite material as set forth in claim 1, wherein the metal oxide gel is modified by an organic polymer, one part by weight metal oxide gel being modified with x part by weight ($0<x<1$) of an organic polymer.

5. The composite material as set forth in claim 4 wherein said organic polymer is selected from the group consisting of cellulose derivatives; starch derivatives; polyalkylene glycols or derivatives thereof; acrylate and methacrylate-based homo- or copolymerisates; polystyrene sulfonate; natural resins; and a mixture thereof.

6. The composite material as set forth in claim 5 wherein said corrosion inhibitor is selected from the group consisting of substituted phenols, hydroquinone and quinone derivatives, nitrites, organic acids, salts of organic acids, aliphatic or aromatic amines, amides, thiazoles, triazoles, imidazoles and mixtures thereof.

7. The composite material as set forth in claim 6, wherein the metal oxide gel contains $SiO_2$, $Al_2O_3$, $TiO_2$, $ZrO_2$ or ZnO or mixtures thereof and wherein the volatile corrosion inhibitors are present in an amount of 1–50% by weight based on the weight of the metal oxide in the gel.

8. The composite material as set forth in claim 1, wherein the metal oxide gel contains $SiO_2$, $Al_2O_3$, $TiO_2$, $ZrO_2$ or ZnO or mixtures thereof, and wherein the volatile corrosion inhibitors are present in an amount of 1–50% by weight based on the weight of the metal oxide in the gel.

9. The composite material of claim 8 wherein the corrosion inhibitors are present in an amount of 1–15% by weight.

10. The composite material of claim 8 wherein the corrosion inhibitors are present in an amount of 1–5% by weight.

11. A corrosion-protective material comprising a composite material as claimed in claim 1, coated on or contained in a protective material substrate.

12. The corrosion-protective material as claimed in claim 11, wherein the protective material substrate is a packaging substrate material coated or impregnated with the composite.

13. The corrosion-protective material as claimed in claim 11, further comprising a solid filler material containing the composite.

14. A method of producing a corrosion-inhibiting composite material comprising the following steps:

(a) producing a metal oxide sol containing $SiO_2$, $Al_2O_3$, $TiO_2$, $ZrO_2$ or ZnO or mixtures of the metal oxides optionally modified by R-$SiO_n$ wherein R is alkyl and n is a value <2, by hydrolysis of the corresponding metal alkoxides in an aqueous, organic or mixed solvent, (b) dissolving one or more volatile corrosion inhibitors in the metal oxide sol, (c) gelling the corrosion inhibitor-containing metal oxide sol by heating and/or neutralizing or by coating on a substrate, wherein the volatile corrosion inhibitor is homogeneously distributed in a molecular-dispersed manner in the metal oxide gel, and (d) removing the solvent.

15. The method claimed in claim 14, wherein a dissolved or dispersed polymer is added to the metal oxide sol in step (a) or (b).

16. The method claimed in claim 15, wherein paper, carton, polymer films or expanded materials, textile fabric or the metallic or metallized articles to be protected directly are used as the substrate in step (c).

17. The method claimed in claim 14, wherein paper, carton, polymer films or expanded materials, textile fabric or the metallic or metallized articles to be protected directly are used as the substrate in step (c).

* * * * *